US005947346A

United States Patent [19]

London

[11] Patent Number: 5,947,346

[45] Date of Patent: Sep. 7, 1999

[54] APPARATUS FOR DISPENSING ASPHALT

[76] Inventor: Joseph T. London, 9275 N.C. 65, Stokesdale, N.C. 27357

[21] Appl. No.: 08/798,699

[22] Filed: Feb. 12, 1997

[51] Int. Cl.[6] ..... B67D 5/64

[52] U.S. Cl. ..... 222/608; 222/565; 239/563; 239/170; 401/48

[58] Field of Search ..... 222/608, 185.1, 222/565; 239/170, 436, 581.1, 586, 562, 563; 401/48, 137, 140; 280/62

[56] References Cited

U.S. PATENT DOCUMENTS

| | | | |
|---|---|---|---|
| 1,172,295 | 2/1916 | Moy | 239/563 |
| 2,273,599 | 2/1942 | Smith et al. | 91/30 |
| 2,884,203 | 4/1959 | Broughton | 239/581.1 |
| 3,135,430 | 6/1964 | Caldwell | 222/178 |
| 3,399,903 | 9/1968 | Bailey | 280/62 |
| 4,165,192 | 8/1979 | Mellen | 401/48 |
| 4,265,559 | 5/1981 | Mellen | 401/48 |
| 4,537,331 | 8/1985 | Matula | 222/165 |
| 4,817,870 | 4/1989 | Dalton | 239/170 |
| 5,254,167 | 10/1993 | Janoski et al. | 118/108 |
| 5,358,347 | 10/1994 | Morris | 401/48 |
| 5,366,308 | 11/1994 | Crispino | 401/1 |
| 5,419,647 | 5/1995 | Kirk et al. | 401/48 |
| 5,441,583 | 8/1995 | Eaton et al. | 156/71 |

OTHER PUBLICATIONS

Catalog Sheets of Reeves Roofing Equipment Co., Inc., pp. 19–20; date unknown; believed to be prior art (no date available).

*Primary Examiner*—Steven O. Douglas
*Attorney, Agent, or Firm*—Rhodes, Coats & Bennett, L.L.P.

[57] ABSTRACT

A mobile asphalt dispenser for applying strips of asphalt having prescribed widths to a roof. The dispenser has a frame including an asphalt container for holding the asphalt. At least one wheel is rotatably mounted on the frame. A valve assembly is provided in fluid communication with the asphalt container and is operable to control flow of the asphalt from the container to the roof. The dispenser has a valve assembly selectively positionable into at least three prescribed positions, each of the prescribed positions corresponding to a respective one of the prescribed widths of the asphalt strips. In addition to or as an alternative to the valve assembly, the dispenser may include a side dispensing arm for applying asphalt to a cant of the roof. Preferably, the dispenser is provided with a swivellable wheel.

26 Claims, 6 Drawing Sheets

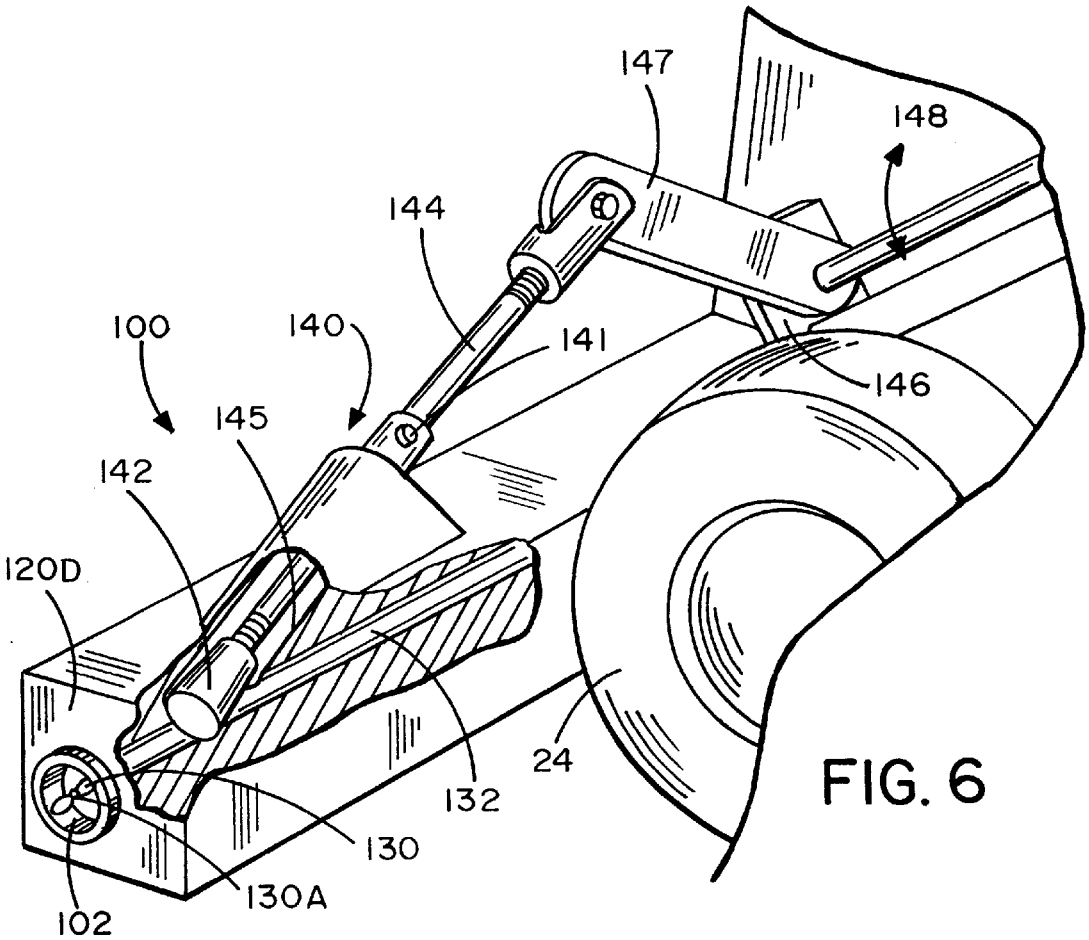
FIG. 6
FIG. 7
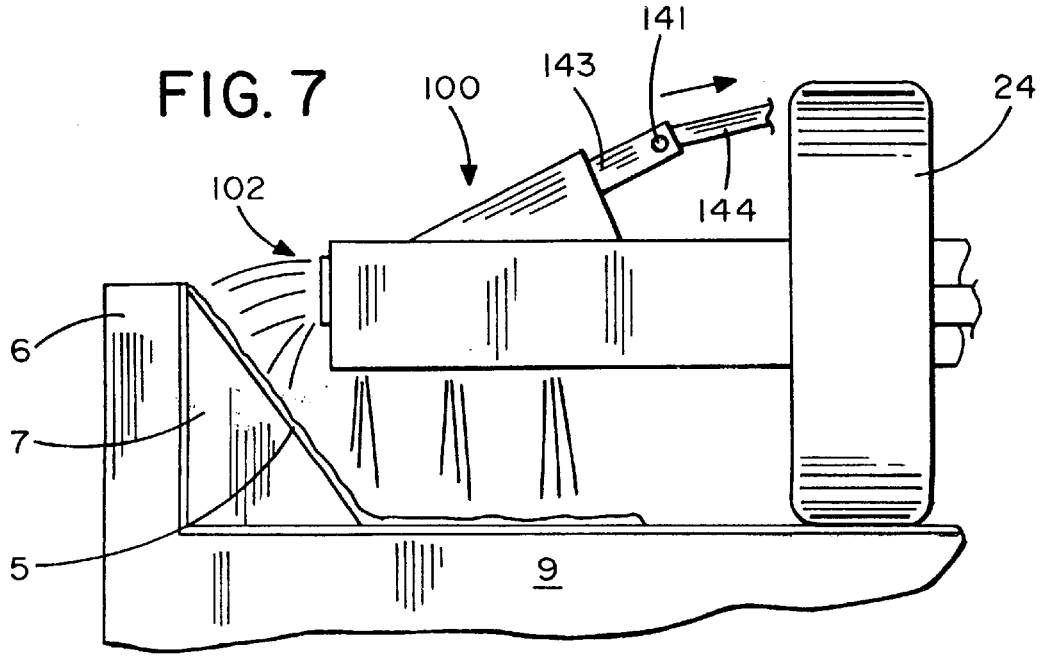

APPARATUS FOR DISPENSING ASPHALT

FIELD OF THE INVENTION

The present invention is directed to an apparatus and method for constructing roofs, and, more particularly, to an apparatus and method for dispensing hot asphalt onto a roofing surface.

BACKGROUND OF THE INVENTION

Buildings having flat roofs or roofs having only slight pitch are often provided with multi-ply roof constructions. A base sheet and several layers of roofing felt and insulation panels are superimposed to build up the ultimate roof. To seal and adhere the respective layers to the roof and to adjacent layers, a layer of liquid roofing composition (hereinafter "asphalt") typically including a mixture of tar, pitch, and bituminous components is interposed between each layer. The means and methods of applying the asphalt to successive layers heretofore employed have generally been slow, labor intensive, and inefficient.

One method used to apply asphalt is to dip a mop into a bucket or wheelbarrow containing heated asphalt and to spread the asphalt using the mop. It is not uncommon for such mops when loaded with asphalt to weigh on the order of 85 lbs. or more. Moreover, the fumes and heat of the asphalt require that the user hold the mop handle relatively far away from the mop head, thus increasing the effective weight by leverage. An alternative method is to pour quantities of the asphalt onto the roof and to use the mop to spread the asphalt. In either method, great physical effort is required and the rate at which the asphalt may be applied is low.

To reduce the drawbacks of the mop method, various apparatus have been developed for dispensing strips of hot asphalt of substantially uniform thickness. These devices typically include a wheeled tank for holding hot asphalt. A slot or series of openings are formed along the bottom of the tank. The asphalt is gravity fed through the openings. The rate at which the asphalt is dispensed may be controlled by a valve.

One such device, the MINI MOPPER™ coater from Garlock Inc. of Texas, employs a rotary bar valve having a hollow, cylindrical tube with opposed transverse holes formed therethrough. When the tube is rotated into an "open" position, asphalt from the tank is able to flow through the holes. When the tube is rotated into a "closed" position, the ends of the holes are closed off by adjacent walls. A third, transverse hole is formed between each of the first two holes. When the tank is in the closed position, the third hole serves as a drain for asphalt trapped in the tube. The tube is provided with two or three series of dispensing holes which allow the device to dispense asphalt strips of different widths. The apparatus discussed above, while a significant improvement over application by mopping, suffers several significant drawbacks in practice.

In order to properly apply a multi-ply roof, different widths of materials and different widths of overlap must be used. The strips of asphalt applied prior to laying these materials should be of widths corresponding to the width of the material or the desired overlap. For example, insulation panels are typically 2 feet by 4 feet, 3 feet by 4 feet, 4 feet by 4 feet, or 4 feet by 8 feet. Ideally, the panels are applied by applying a strip of asphalt which is 28 inches, 38 inches, or 48 inches wide, respectively, and laying the panels end to end onto the asphalt while it is still hot liquid. Further, at the edges of a roof it may be necessary to break the insulation panels into smaller widths to achieve a proper fit. The above described device cannot be efficiently used to apply all such full and partial panels because it has only two or three dispensing widths. A similar problem is encountered at the cants and tie-ins of a roof. At these locations, felt layers are laid in successively wider, overlapping widths. Typically, a 9 inch wide felt is applied, followed by an 18 inch wide felt, followed by a 27 inch wide felt, followed by a 36 inch wide felt. Asphalt strips of appropriate widths must be applied for each layer. Again, the devices discussed above are unable to apply all such widths. Where the dispensing apparatus cannot be employed, the asphalt must be applied by mop.

Another problem encountered with the above described device results from the use of a hollow tube for the bar valve. Notwithstanding the provision of the drain holes, in practice a substantial amount of asphalt trapped in the tube upon closing the valve cools and hardens before it can escape through the drain holes.

Another problem experienced with dispensing apparatus as described above is that they are difficult to maneuver. Moreover, these apparatus are generally formed from steel, making them very heavy.

Another portion of a roof which requires the application of hot asphalt is the cant along each edge. The cant is a wedge shaped strip typically angled at about 45° which provides a slope between a raised lip along the roof perimeter and the roof. Conventionally, asphalt is applied to the cant by the mop method. The dispensing devices as discussed above do not provide for dispensing of asphalt onto the cant. One device designed to avoid mopping of asphalt onto the cant uses a wide roller which passes through a pool of asphalt. A strip of roofing felt is manually drawn over the roller which transfers asphalt onto the felt. The felt is then laid onto the roof. This process is messy and difficult to employ as the felt tends to twist and buckle, particularly if wind is present.

Thus, there exists a need for a convenient and cost effective apparatus for applying strips of hot asphalt to a roof. Moreover, there exists a need for such an apparatus which may be used to selectively apply strips of hot asphalt of different widths. There exists a need for a mobile hot asphalt dispenser which is more easily maneuverable. Further there exists a need for an apparatus and a method for applying hot asphalt from a mobile asphalt dispenser onto a cant of a roof. Additionally, there is a need for a means for reducing or eliminating the tendency of asphalt in a rotary bar valve to cool and harden before draining therefrom when the bar valve is placed in a closed position.

SUMMARY OF THE INVENTION

The present invention is directed to a mobile asphalt dispenser for applying strips of asphalt having prescribed widths to a roof. The dispenser includes a frame including an asphalt container for holding the asphalt. At least one wheel is rotatably mounted on the frame. A valve assembly in fluid communication with the asphalt container is operable to control flow of the asphalt from the container to the roof. The valve assembly is selectively positionable into at least three prescribed positions. Each of the prescribed positions corresponds to a respective one of the prescribed widths of the asphalt strips.

Preferably, the valve assembly is selectively positionable into at least six prescribed positions corresponding to at least six prescribed widths of the asphalt strips. More preferably, the at least six prescribed widths of the asphalt strips are about 10 inches, 13 inches, 19 inches, 28 inches, 38 inches, and 48 inches.

The valve assembly may include a bar having a length and a plurality of bores formed fully therethrough transverse to the length of the bar. The valve assembly may further include a housing having a plurality of openings spaced along the length of the bar and through which the asphalt may be dispensed. Preferably, at least one of the prescribed positions of the valve assembly may be selected by rotating the bar about the length of the bar, and at least one other of the prescribed positions may be selected by moving the bar in a direction parallel to the length of the bar. A first linkage may be provided for rotating the bar about the length of the bar. A second linkage may be provided for moving the bar in the direction parallel to the length of the bar. The bar may further include a plurality of second bores extending partially through the bar transverse to the length of the bar. Each of the second bores intersects and terminates at a respective one of the plurality of first bores. Preferably, the bar is substantially solid except for the first and second bores.

The dispenser preferably has a directable wheel rotatably and swivellably mounted on the frame. Further, the frame is preferably formed from aluminum.

The dispenser may include a side dispenser in fluid communication with the asphalt container. The side dispenser is operable to dispense the asphalt sidewardly with respect to a path of the at least one wheel. A valve may be provided for selectively controlling the flow of the asphalt through the side dispenser. The side dispenser may include an arm extending sidewardly beyond the at least one wheel.

The present invention is further directed to a bar for use in a valve assembly of the type for controlling flow of asphalt from an asphalt container. The bar has a length, at least one first bore extending fully therethrough transverse to the length, and at least one second bore extending partially therethrough transverse to the length. The at least one second bore intersects and terminates at the at least one first bore, the bar being substantially solid except for the first and second bores. Preferably, the bar includes a plurality of the first bores and a plurality of the second bores.

The present invention is further directed to a mobile asphalt dispenser for applying strips of asphalt to a roof. The dispenser has a frame including an asphalt container for holding the asphalt. First and second spaced apart wheels are rotatably mounted on the frame. A third wheel is rotatably and swivellably mounted on the frame. The dispenser also includes a valve assembly operable to control flow of the asphalt from the asphalt container to the roof.

Preferably, the valve assembly is positionable into a plurality of prescribed positions, each of the positions corresponding to a different width strip of the asphalt. Moreover, a side dispenser may be provided in fluid communication with the asphalt container, the side dispenser operable to dispense the asphalt sidewardly with respect to a path of the first and second wheels. Preferably, the frame is formed from aluminum.

The present invention is further directed to a side dispenser for use with an asphalt container for applying asphalt along a cant of a roof. The side dispenser includes a nozzle having a conduit and an end wall. The end wall has an opening formed therein and in fluid communication with the conduit. The conduit and the opening are arranged and configured to direct the asphalt laterally when the asphalt is forced through the conduit and the opening. A plurality of blades are rotatably mounted adjacent the opening, the blades operative when the asphalt exits the conduit through the opening to broadcast the asphalt in a fan-like manner.

Further, the present invention is directed to a mobile asphalt dispenser for applying asphalt along a cant of a roof as follows. The dispenser has a frame including an asphalt container for holding the asphalt and at least one wheel rotatably mounted on the frame. A side dispenser is mounted on the frame. The side dispenser includes a nozzle having a conduit and an end wall, the end wall having an opening formed therein and in fluid communication with the conduit. The conduit is in fluid communication with the asphalt container whereby the asphalt may flow from the asphalt container and through the conduit and exit the conduit through the opening. The opening and the conduit are arranged and configured to direct the asphalt laterally onto the cant.

Preferably, the dispenser as just described includes a valve for selectively controlling the flow of the asphalt through the opening. A plurality of blades may be rotatably mounted adjacent the opening, the blades operative when the asphalt exits the conduit through the opening to broadcast the asphalt. In addition to the side dispenser, the dispenser may include a valve assembly operable to vertically dispense strips of the asphalt having prescribed widths onto the roof. The valve assembly is positionable into a plurality of prescribed positions, each of the positions corresponding to a different width strip of the asphalt. Preferably, the dispenser has a directable wheel rotatably and swivellably mounted on the frame. The frame is preferably formed from aluminum.

The present invention is further directed to a method for applying asphalt to a cant of a roof. The method includes transporting a dispenser along a path substantially parallel to the cant. The asphalt is dispensed from the dispenser laterally with respect to the path.

An object of the present invention is to provide a mobile hot asphalt dispenser which may be conveniently and cost effectively operated.

Another object of the present invention is to provide such a dispenser which is more easily maneuverable.

A further object of the present invention is to provide a dispenser for hot asphalt which selectively applies strips of asphalt of different prescribed widths.

A further object of the present invention is to provide a means for applying hot asphalt to the cant of a roof.

Yet another object of the present invention is to provide a means for reducing or eliminating the tendency of hot asphalt to cool and harden within a rotary bar valve before it can escape.

The preceding and further objects of the present invention will be appreciated by those of ordinary skill in the art from a reading of the Figures and the detailed description of the preferred embodiment which follow, such description being merely illustrative of the present invention.

BRIEF DESCRIPTION OF THE DRAWINGS

FIG. 6 is a rear, perspective, fragmentary view of a side dispensing arm forming a part of the dispensing apparatus; and FIG. 7 is a fragmentary, rear elevational view of the side dispensing arm applying asphalt to the cant of a roof.

DETAILED DESCRIPTION OF THE PREFERRED EMBODIMENT

Figure 1:
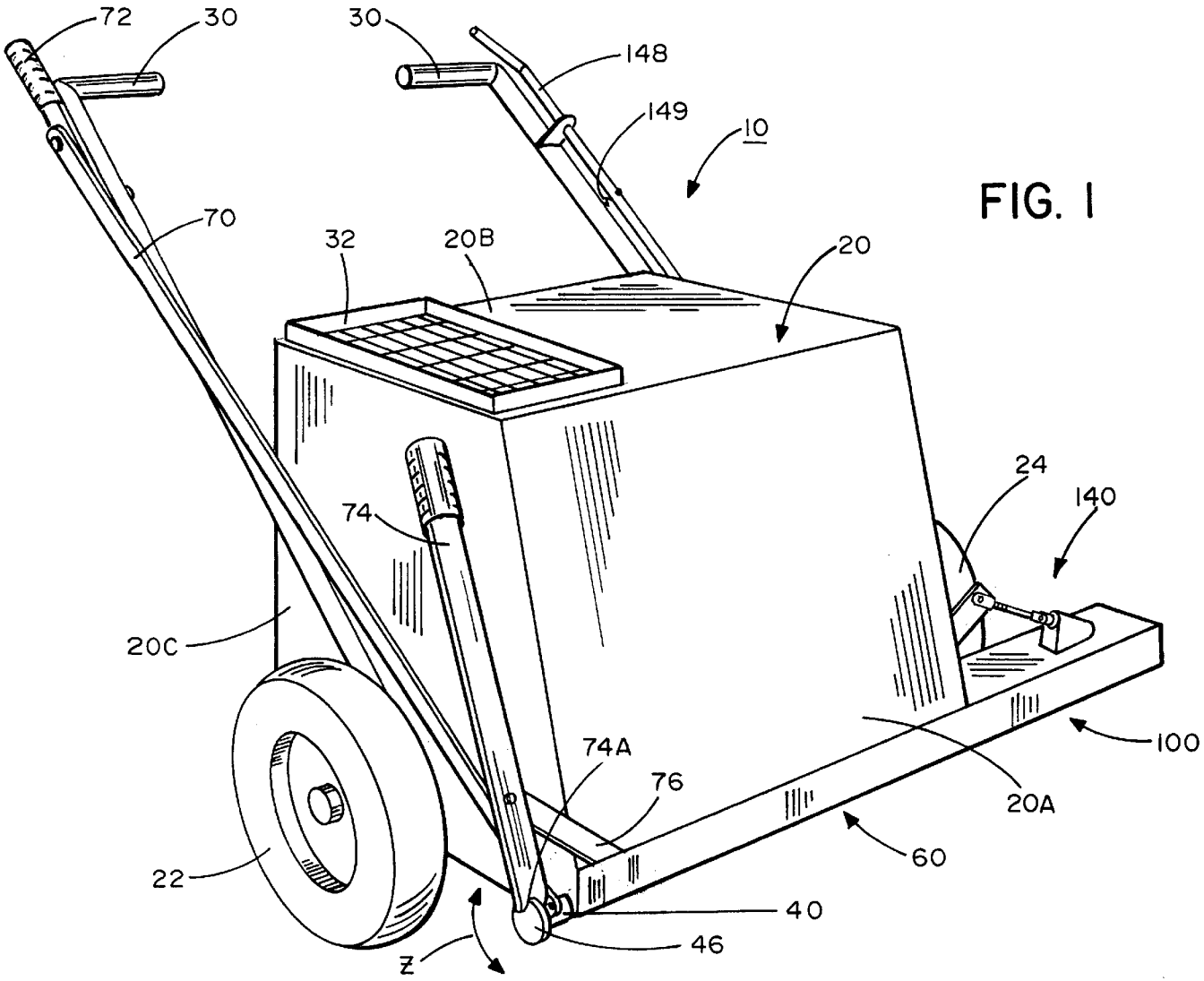
FIG. 1 is a front perspective view of a dispensing apparatus according to the present invention.
Figure 2:
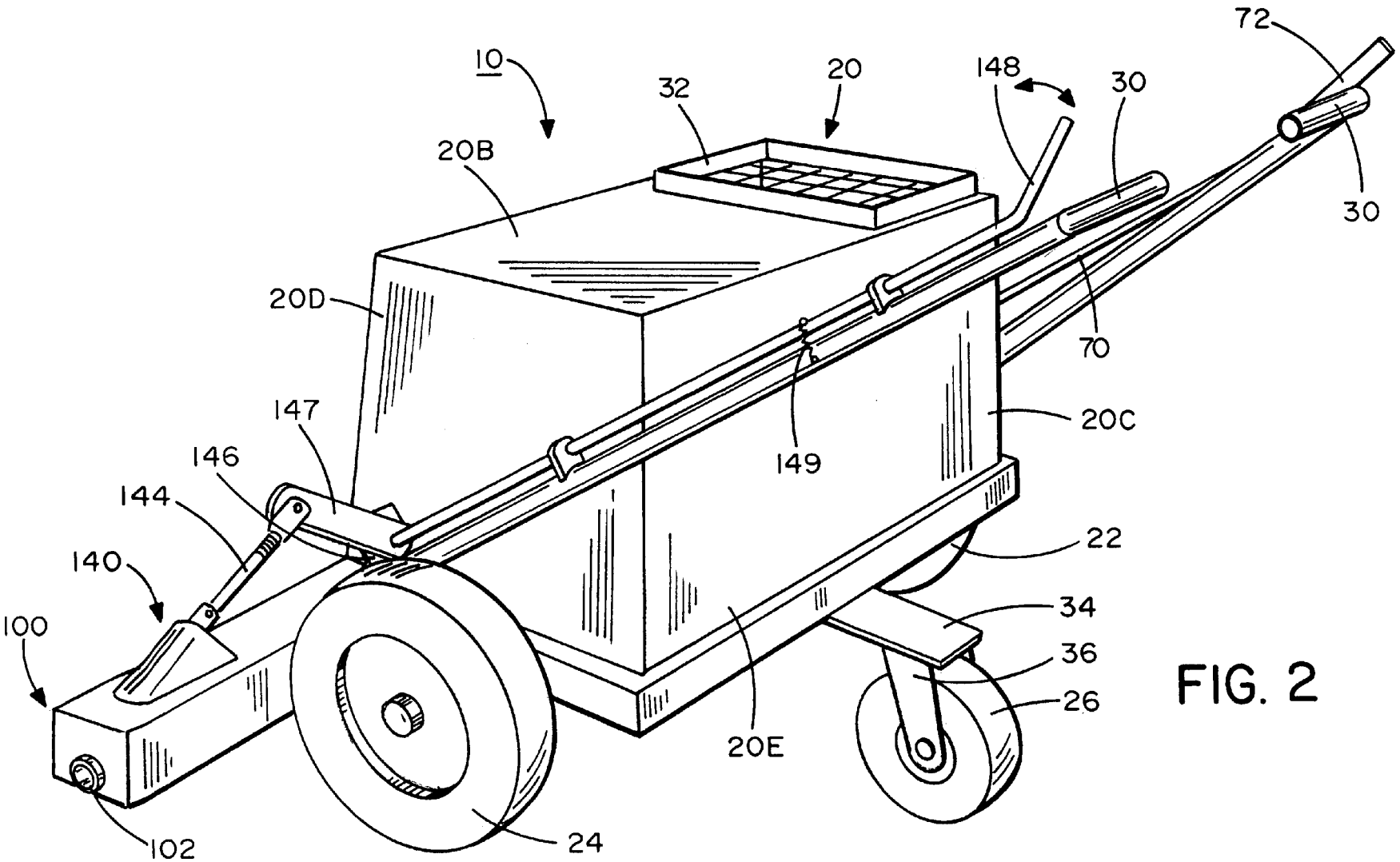
FIG. 2 is a rear perspective view of the dispensing apparatus.

With reference to FIGS. 1 and 2, a mobile hot asphalt dispenser according to the present invention, generally denoted by the numeral 10, is shown therein. Dispenser 10 includes container body 20 which holds hot asphalt (not shown in FIGS. 1 and 2) which may be poured into the container through fill opening 32. Container 20 is preferably formed from aluminum and has front wall 20A, top wall 20B, side wall 20C, side wall 20D, and rear wall 20E. Wheels 22, 24 are rotatably mounted on either side of container 20. As shown in FIG. 2, wheel 26 is rotatably mounted in fork 36. Fork 36 is pivotably mounted on bracket 34 which is in turn fixedly secured to container 20. In this way, wheel 26 and fork 36 form a caster which can be swiveled with respect to the remainder of dispenser 10. Handles 30 are provided to push, pull and direct the dispenser. From the foregoing, it will be appreciated that dispenser 10 is mobile and easily maneuverable on a flat surface such as a flat roof. Maneuverability is further enhanced by the inset placement of wheel 24 with respect to the overall length L (see FIG. 3) of the dispensing valve as discussed below.

Generally, dispenser 10 provides two types of hot asphalt dispensing. The first type of dispensing is the application of a continuous, lengthwise strip of asphalt coating of substantially uniform thickness. The dispenser allows for one of several prescribed widths as selected by the operator. More specifically, dispenser 10 is operable to lay down strips of six preferred widths. The second type of dispensing provided is spreading or broadcasting of asphalt sidewardly or laterally with respect to the dispenser.

Figure 4A:
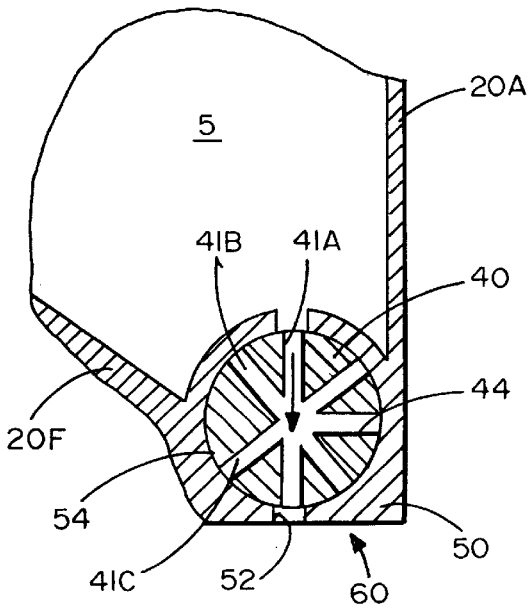
FIG. 4A is a cross-sectional, side, fragmentary view of the valve assembly in an open position.
Figure 4B:
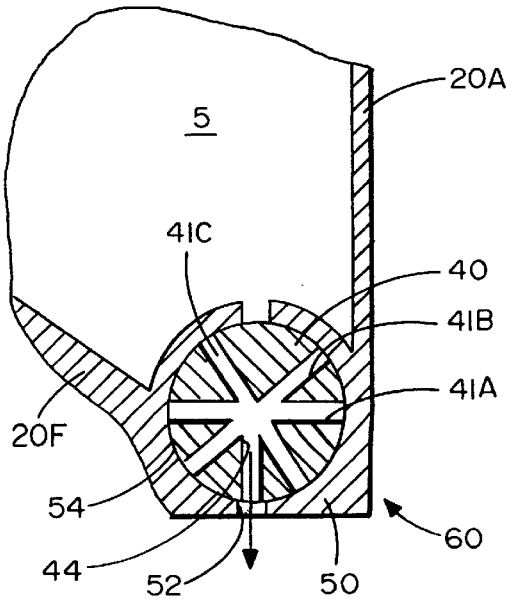
FIG. 4B is a cross-sectional, side, fragmentary view of the valve assembly in a closed, draining position.

The dispensing of asphalt strips of prescribed widths is accomplished by appropriate operation of rotary bar valve assembly 60 by means of linkage 72 and lever 74. Valve assembly 60 preferably extends a length L across substantially the entire front width of container 20 and side dispensing arm 100 (as discussed below). With reference to FIGS. 4A and 4B, valve assembly 60 includes cylindrical bar 40 and valve housing 50. Valve housing 50 is preferably formed integrally with bottom wall 20F and front wall 20A of body 20. Bar 40 is held within housing 50 such that it is rotatable about and slidable along its lengthwise axis with respect to the housing but fits closely against inner surfaces 54. The clearances between the periphery of bar 40 and inner surfaces 54 are preferably on the order of $^{10}/_{1000}{}^{ths}$ of an inch. As discussed in more detail below, bar 40 has formed therein a plurality of through bores 41A, 41B, 41C, 42A, 42B, 42C (an exemplary set of through bores 41A, 41B, 41C being shown in FIGS. 4A and 4B) and drain bores 44. When bar 40 is rotated into a first open position as shown in FIG. 4A, through bore 41A, for example, aligns with a respective opening 52 of valve housing 50 to allow the gravity forced flow of asphalt 5 from container 20, out of opening 52 and onto the roof surface. Similarly, bar 40 may be rotated into second and third positions in which through bores 41B and 41C, respectively, are aligned with opening 52. When bar 40 is rotated to a position as shown in FIG. 4B, the ends of through bores 41A, 41B, 41C are closed off by inner surfaces 54. Drain bore 44 is then aligned with opening 52. The asphalt retained in bore 44 and 41A, 41B, 41C upon closure of the valve assembly drains out through bore 44 and opening 52. Notably, because there is no lengthwise bore formed through the bar and a relatively small amount of asphalt is trapped in bores 41A, 41B, 41C and 44 when the valve is closed (particularly as compared to the conventional hollow tube type bar valves of the prior art), substantially all of the asphalt in the bores drains out of dispenser 10 prior to cooling and hardening.

Figure 3:
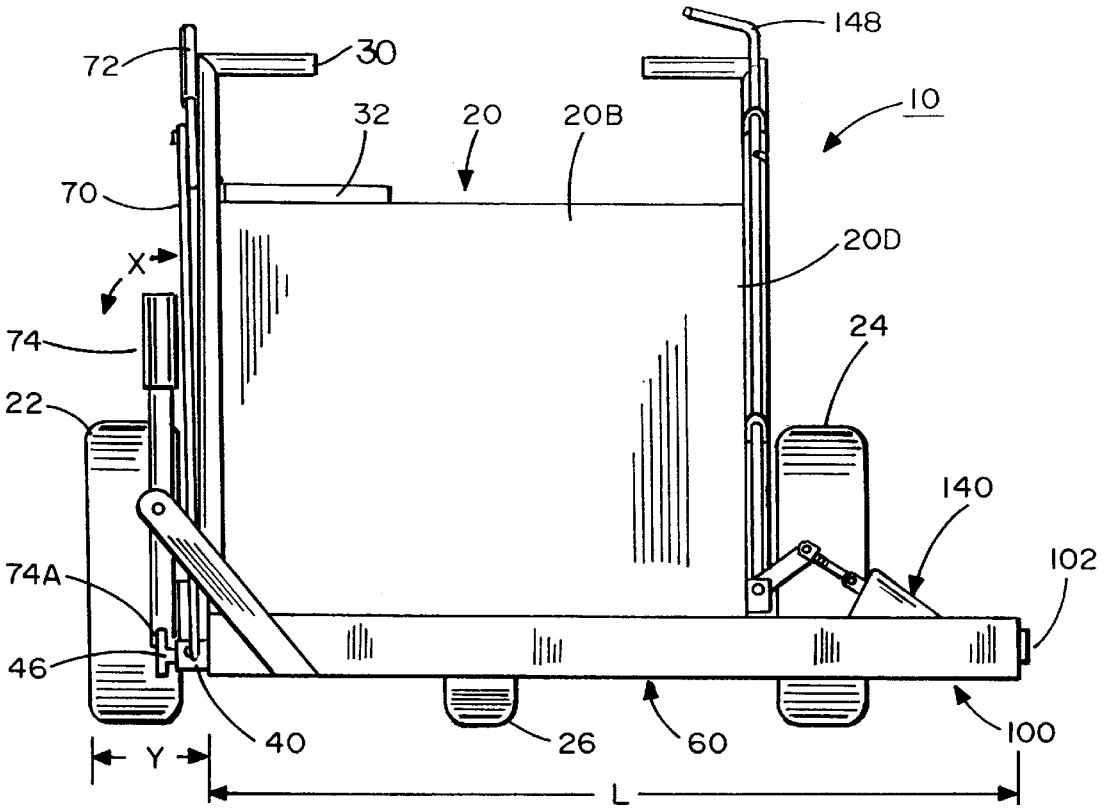
FIG. 3 is a front elevational view of the dispensing apparatus.

Dispenser 10 is configured to lay asphalt strips of about 10 inches, 13 inches, 19 inches, 28 inches, 38 inches or 48 inches, as selected by the operator. With reference to FIG. 1, bar 40 is rotatable about its lengthwise axis by means of linkage 72 and connecting arm 70. Linkage 72 and bar 40 are connected such that the operator may rotate bar 40 in direction Z (see FIG. 1) into four positions. Preferably, a suitable detent (not shown) and cooperating projection (not shown) are provided on the bar and valve housing to positively position and retain the bar in each of the chosen positions. With reference to FIG. 3, bar 40 may be moved in or out along linear directions Y (see FIG. 3) by pivoting lever 74 toward or away from the dispenser along directions X and about brace 76. Fork end 74A engages cap 46 formed on the end of bar 40. The combination of plural linear positions and plural rotational positions allows the provision of greater than three different, selectable dispensing widths.

Figure 5A:
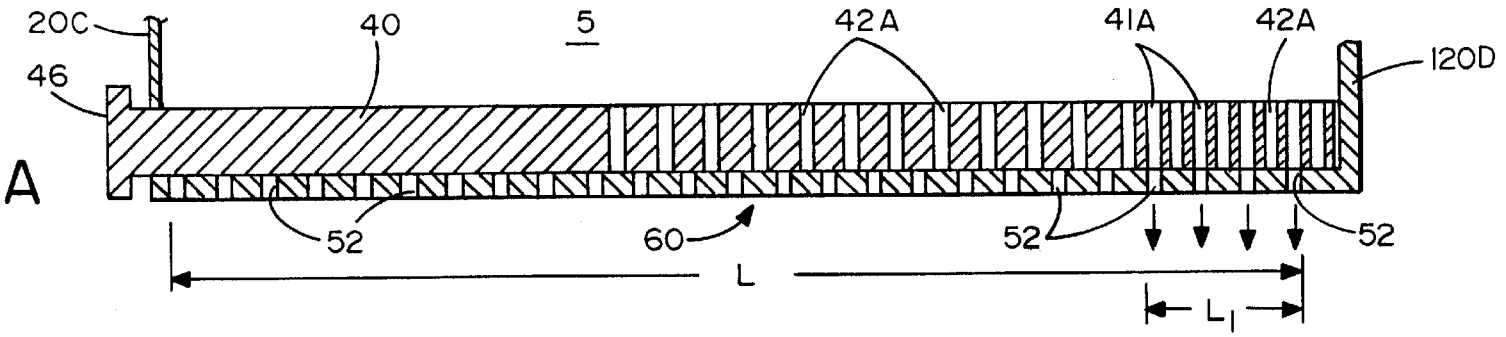
FIGS. 5A–5F are schematic, cross-sectional, front, fragmentary views of the valve assembly in each of six open positions corresponding to six different dispensing widths.
Figure 5B:
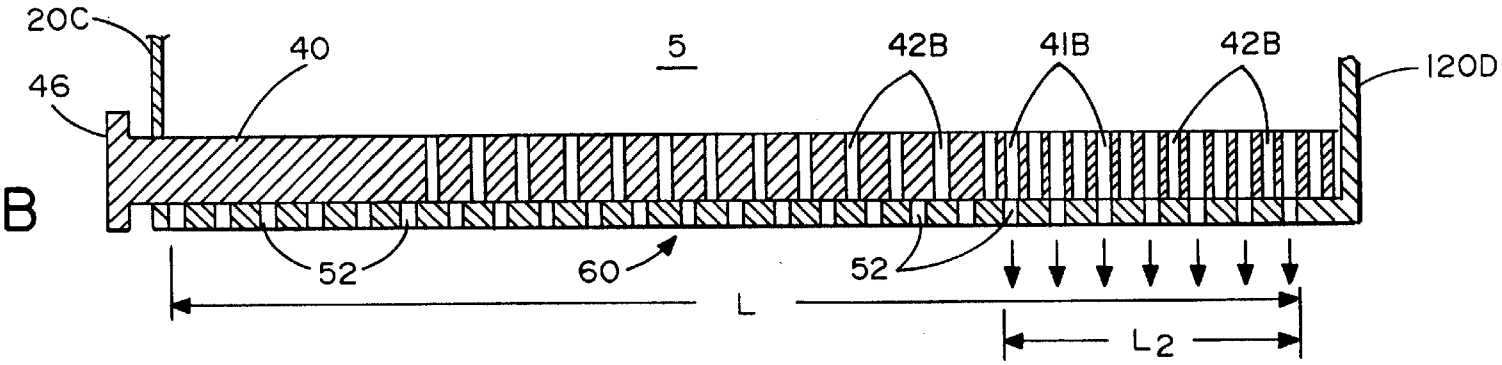
Figure 5C:
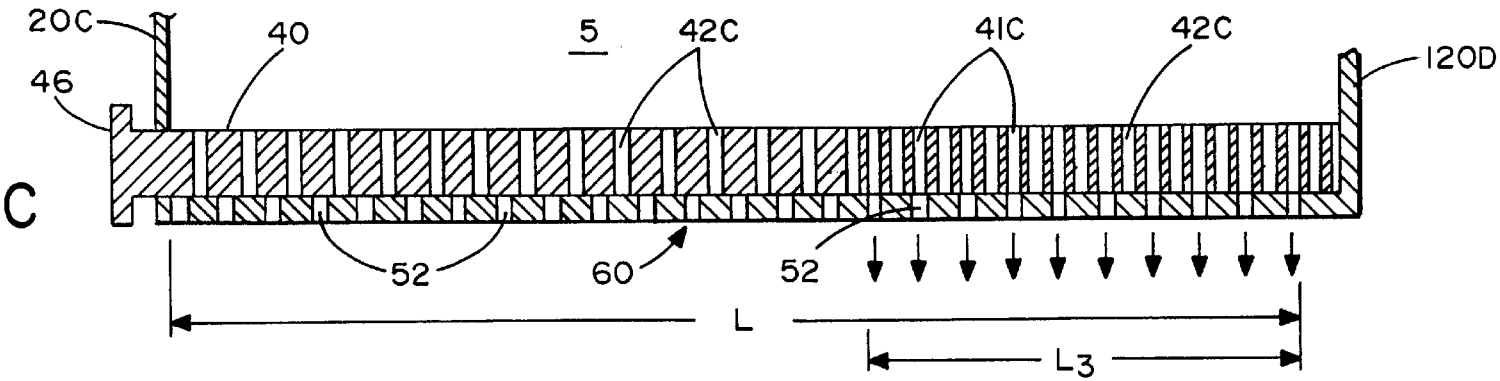

The first three prescribed widths of asphalt strips are chosen by moving bar 40 inwardly by means of lever 74 to a first linear position as shown in FIGS. 5A–5C. Bar 40 is rotated into a first rotational position as shown in FIG. 5A by means of linkage 72. When bar 40 is in the first linear position and the first rotational position as shown in FIG. 5A, a first series of through bores 41A are registered with some of the openings 52 of the valve housing. In this way, asphalt is only allowed to flow out of those openings. An asphalt strip having a width L1, preferably about 10 inches (i.e., one inch greater than the width of conventional 9 inch felt), is laid. The thickness of the coating strip may be regulated by the rate at which the dispenser is pulled across the roofing surface and the amount of asphalt held in the container. Notably, when bar 40 is so positioned, another series of through bores 42A are closed at their lower ends by the valve housing.

A second width of asphalt may be dispensed by leaving bar 40 in the first linear position and rotating it into a second rotational position as shown in FIG. 5B. In this position, a second set of through bores 41B are aligned with certain openings 52. In this way, an asphalt strip having width L2, preferably about 13 inches (i.e., one inch greater than the width of conventional 12 inch felt), is dispensed.

A third width of asphalt may be dispensed by maintaining bar 40 in the first linear position and rotating it into a third rotational position as shown in FIG. 5C. In this position, a third series of through bores 41C are aligned with certain openings 52 so that asphalt is allowed to flow through these openings. In this way, an asphalt strip having a width L3, preferably about 19 inches (i.e., one inch greater than the width of conventional 18 inch felt), is dispensed.

Figure 5D:
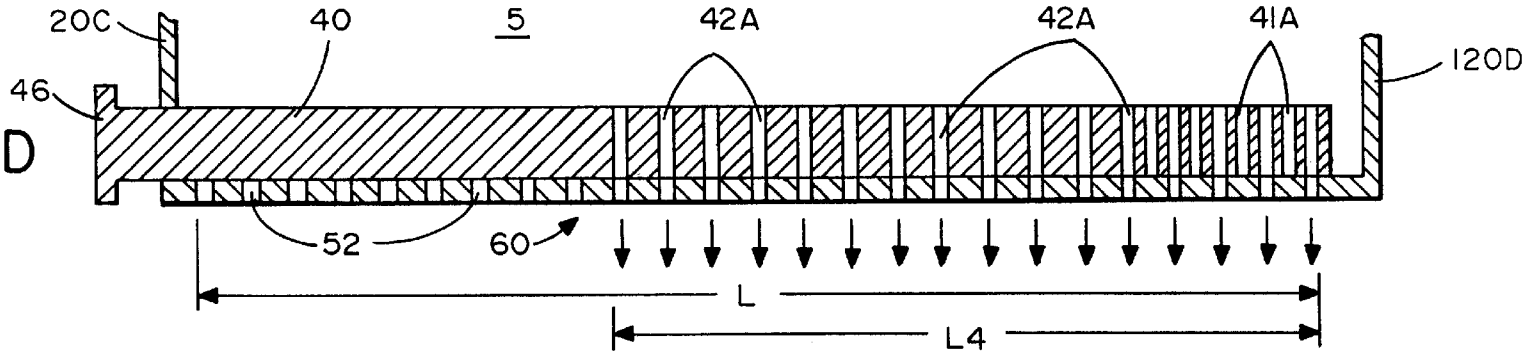
Figure 5E:
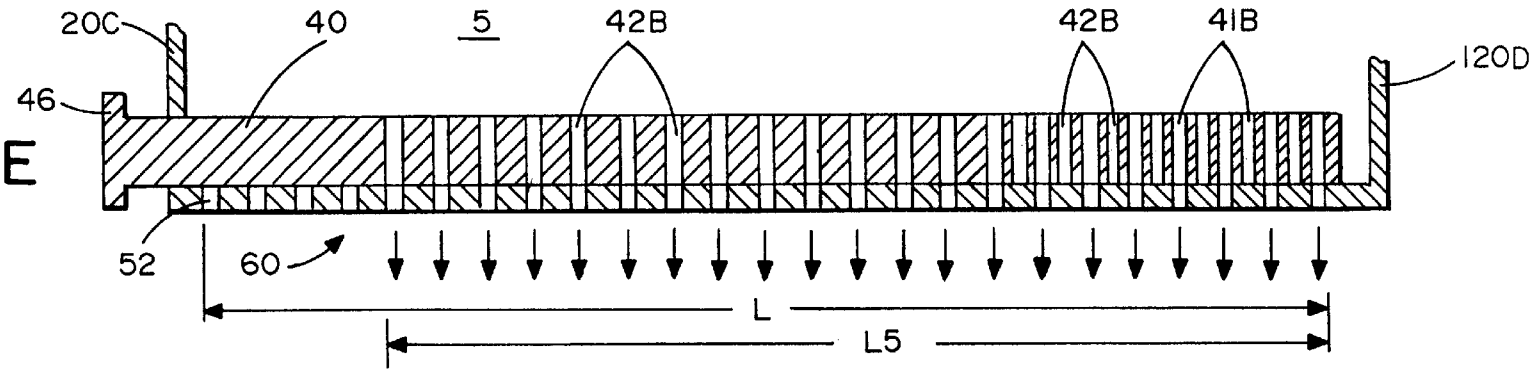
Figure 5F:
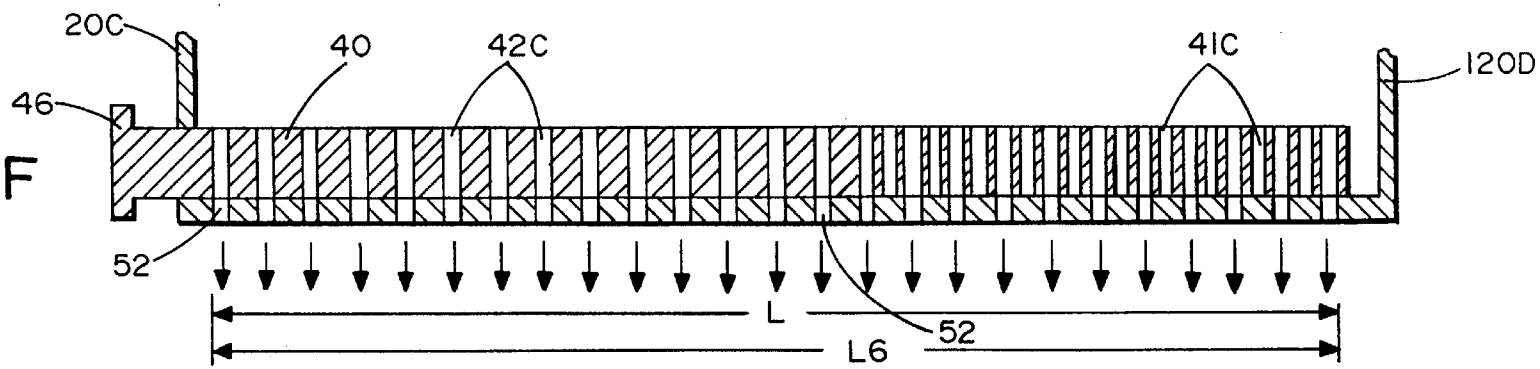

To dispense an asphalt strip of a fourth width, bar 40 is pulled outwardly by means of lever 74 into a second linear position as shown in FIGS. 5D–5F. Bar 40 is again rotated into the first rotational position (i.e., as in FIG. 5A). When bar 40 is so positioned relative to valve housing 50, a fourth series of through bores 42A are registered with openings 52. In this way, an asphalt strip having width L4, preferably 28 inches (i.e., one inch greater than the width of conventional 27 inch felt), is dispensed.

An asphalt strip having a fifth width may be dispensed by leaving bar 40 in the second linear position and rotating bar 40 again into the second rotational position, as shown in FIG. 5E. In this position, a fifth series of through bores 42B are aligned with openings 52. As a result, an asphalt strip having a width L5, preferably 38 inches (i.e., two inches greater than the width of a conventional 36 inch felt to which rocks are generally to be applied), is dispensed.

To dispense an asphalt strip having a sixth width, bar 40 is maintained in the second linear position and again rotated into the third rotational position as shown in FIG. 5F. When bar 40 is in this position, a sixth series of through bores 42C are aligned with openings 52. In this way, an asphalt strip having a width L6, preferably 48 inches (i.e., the width of 4 foot insulation panels), is dispensed.

When the operator does not desire to dispense asphalt, bar 40 is rotated by means of linkage 72 into a fourth rotational position (not shown) in which a series of drain bores 44 are aligned with openings 52.

With reference to FIGS. 6 and 7, side dispensing arm 100 serves to laterally dispense hot asphalt onto a cant of a roof. A cant 7 is commonly used at the corner between an edge lip 6 and the top of a roof 9. Arm 100 has conduit 132 formed therethrough which is connected to container 20 at its upstream end so that hot asphalt may flow therethrough. Conduit 132 terminates at orifice 102 formed in end wall 120D. The flow of hot asphalt through conduit 132 is controlled by slide valve assembly 140. More specifically, piston 142 is selectively positioned in conduit 132 or, alternatively, drawn into cylinder 145 by pulling or pushing lever 148 (thereby rotating the lever as shown by the direction arrows in FIGS. 2 and 6), which in turn pivots plate 147 which is mounted on fixed bracket 146. Piston 142 is connected to plate 147 by rods 143, 144 with an end of rod 143 hingedly connected to an end of rod 144 by pin 141. Spring 149 (see FIG. 2) biases lever 148 into a closed position wherein piston 142 is positioned in conduit 132.

When valve assembly 140 is opened by drawing piston 142 out of conduit 132, the hot asphalt is pressure fed out of orifice 102 by the gravity pressure head of the hot asphalt held in container body 20. As a result, the hot asphalt flows outwardly from end wall 120D. Notably, because arm 100 extends sidewardly with respect to the path of wheel 24, end wall 120D and opening 102 may be positioned over or closely adjacent the cant.

Impeller or fan-like twisted metal blades 130 are rotatably mounted in orifice 102. The hot asphalt rushing by blades 130 causes the blades to rotate about pivot point 130A. The spinning of blades 130 serves to broadcast or throw the hot asphalt outwardly with respect to its flow path so that it spreads more broadly. In this way, a wider and more even coating of hot asphalt is applied to the cant.

Preferably, valve assembly 60 extends through side dispensing arm 100 so that the widest dispensing width L6 is greater than the spacing between wheels 22, 24. In this way, a wide width is dispensable without adversely affecting the maneuverability of dispenser 10 as would be the case if the wheels were spaced apart greater than width L.

While a preferred embodiment of the present invention has been described, it will be appreciated by those of skill in the art that certain modifications may be made without departing from the scope of the present invention. For example, fill opening 32 may be formed flush with wall 20B and may be provided with a door. All such modifications are intended to come within the scope of the claims which follow.

What is claimed is:

1. A mobile asphalt dispenser for applying strips of asphalt having prescribed widths to a roof, said dispenser comprising:

a) a frame including an asphalt container for molding the asphalt;

b) at least one wheel rotatably mounted on said frame;

c) a valve assembly in fluid communication with said asphalt container and operable to control flow of the asphalt from said container to the roof; and d) said valve assembly selectively positionable into at least three prescribed positions, each of said prescribed positions corresponding to a respective one of the prescribed widths of the asphalt strips, wherein at least one of said prescribed positions of said valve assembly may be selected by rotating said bar about said length of said bare and at least one other of said prescribed positions may be selected by moving said bar in a direction parallel to said length of said bar.

2. The dispenser of claim 1 wherein said valve assembly is selectively positionable into at least six prescribed positions corresponding to at least six prescribed widths of the asphalt strips.

3. The dispenser of claim 2 wherein said at least six prescribed widths of the asphalt strips are about 10 inches, 13 inches, 19 inches, 28 inches, 38 inches, and 48 inches.

4. The dispenser of claim 1 wherein said valve assembly includes a bar having a length and a plurality of bores formed fully therethrough transverse to said length of said bar.

5. The dispenser of claim 4 wherein said valve assembly includes a housing having a plurality of openings spaced along said length of said bar and through which the asphalt may be dispensed.

6. The dispenser of claim 1 including a first linkage for rotating said bar about said length of said bar and a second linkage for moving said bar in said direction parallel to said length of said bar.

7. The dispenser of claim 1 including a directable wheel rotatably and swivellably mounted on said frame.

8. The dispenser of claim 1 wherein said frame is formed from aluminum.

9. A mobile asphalt dispenser for applying strips of asphalt having prescribed widths to a roof, said dispenser comprising:

a) a frame including an asphalt container for holding the asphalt;

b) at least one wheel rotatably mounted on said frame;

c) a valve assembly in fluid communication with said asphalt container and operable to control flow of the asphalt from said container to the roof;

d) said valve assembly selectively positionable into at least three prescribed positions, each of said prescribed positions corresponding to a respective one of the prescribed widths of the asphalt strips; and e) a side dispenser in fluid communication with said asphalt container and operable to dispense the asphalt sidewardly with respect to a path of said at least one wheel, wherein said side dispenser includes an arm extending sidewardly beyond said at least one wheel.

10. The dispenser of claim 9 including a valve for selectively controlling the flow of the asphalt through said side dispenser.

11. A bar for use in a valve assembly of the type for controlling flow of asphalt from an asphalt container, said bar having a length, at least one first bore extending fully therethrough transverse to said length, and at least one second bore extending partially therethrough transverse to said length, said at least one second bore intersecting and terminating at said at least one first bore, said bar being substantially solid except for said first and second bores.

12. The bar of claim 11 including a plurality of said first bores and a plurality of said second bores.

13. A side dispenser for use with an asphalt container for applying asphalt along a cant of a roof, said side dispenser comprising:

a) a nozzle having a conduit and an end wall, said end wall having an opening formed therein and in fluid communication with said conduit;

b) said conduit and said opening arranged and configured to direct the asphalt laterally when the asphalt is forced through said conduit and said opening; and c) a plurality of blades rotatably mounted adjacent said opening, said blades operative when the asphalt exits said conduit through said opening to broadcast the asphalt.

14. A mobile asphalt dispenser for applying asphalt along a cant of a roof, said dispenser comprising:

a) a frame including an asphalt container for holding the asphalt;

b) at least one wheel rotatably mounted on said frame;

c) a side dispenser mounted on said frame, said side dispenser including a nozzle having a conduit and an end wall, said end wall having an opening formed therein and in fluid communication with said conduit, said conduit in fluid communication with said asphalt container whereby the asphalt may flow from said asphalt container and through said conduit and exit said conduit through said opening; and d) wherein said opening and said conduit are arranged and configured to direct the asphalt laterally onto the cant.

15. The dispenser of claim 14 including a valve for selectively controlling the flow of the asphalt through said opening.

16. The dispenser of claim 14 including a plurality of blades rotatably mounted adjacent said opening, said blades operative when the asphalt exits said conduit through said opening to broadcast the asphalt.

17. The dispenser of claim 14 further including a valve assembly operable to vertically dispense strips of the asphalt having prescribed widths onto the roof, wherein said valve assembly is positionable into a plurality of prescribed positions, each of said positions corresponding to a different width strip of the asphalt.

18. The dispenser of claim 14 including a directable wheel rotatably and swivellably mounted on said frame.

19. The dispenser of claim 14 wherein said frame is formed from aluminum.

20. A mobile asphalt dispenser for applying strips of asphalt having prescribed widths to a roof and for applying asphalt to a cant of a roof, said dispenser comprising:

a) a frame including an asphalt container for holding the asphalt;

b) at least one wheel rotatably mounted on said frame;

c) a valve assembly in fluid communication with said asphalt container and operable to control flow of the asphalt from said container to the roof, said valve assembly including a bar having a length and a plurality of bores formed fully therethrough transverse to said length of said bar;

d) said valve assembly selectively positionable into at least three prescribed positions, each of said prescribed positions corresponding to a respective one of the prescribed widths of the asphalt strips;

e) wherein at least one of said prescribed positions of said valve assembly may be selected by rotating said bar about said length of said bar, and at least one other of said prescribed positions may be selected by moving said bar in a direction parallel to said length of said bar;

f) a side dispenser mounted on said frame, said side dispenser including an arm extending sidewardly beyond said at least one wheel and having a conduit and an end wall, said end wall having an opening formed therein and in fluid communication with said conduit, said conduit in fluid communication with said asphalt container whereby the asphalt may flow from said asphalt container and through said conduit and exit said conduit through said opening;

g) wherein said opening and said conduit are arranged and configured to direct the asphalt laterally onto the cant; and h) a valve for selectively controlling the flow of the asphalt through said opening of said side dispenser.

21. The dispenser of claim 20 wherein said valve assembly is selectively positionable into at least six prescribed positions corresponding to at least six prescribed widths of the asphalt strips.

22. The dispenser of claim 21 wherein said at least six prescribed widths of the asphalt strips are about 10 inches, 13 inches, 19 inches, 28 inches, 38 inches, and 48 inches.

23. The dispenser of claim 20 wherein said bar further includes a plurality of second bores extending partially through said bar transverse to said length of said bar, each of said second bores intersecting and terminating at a respective one of said plurality of first bores, said bar being substantially solid except for said first and second bores.

24. The dispenser of claim 20 including a directable wheel rotatably and swivellably mounted on said frame.

25. The dispenser of claim 20 including a plurality of blades rotatably mounted adjacent said opening, said blades operative when the asphalt exits said conduit through said opening to broadcast the asphalt.

26. A mobile asphalt dispenser for applying strips of asphalt having prescribed widths to a roof, said dispenser comprising:

a) a from including an asphalt container for holding the asphalt;

b) at least one wheel rotatably mounted on said frame, c) a valve assembly in fluid communication with said asphalt container and operable to control flow of the asphalt from said container to the roof, wherein said valve assembly includes a bar having a length and a plurality of bores formed fully therethrough transverse to said length of said bar, said bar further including a plurality of second bores extending partially through said bar transverse to said length of said bar, each of said second bores intersecting and terminating at a respective one of said plurality of first bores, said bar being substantially solid except for said first and second bores; and d) said valve assembly selectively positionable into at least three prescribed positions, each of said prescribed positions corresponding to a respective one of the prescribed widths of the asphalt strips.

* * * * *